US009232598B2

(12) United States Patent
Lin et al.

(10) Patent No.: US 9,232,598 B2
(45) Date of Patent: Jan. 5, 2016

(54) OPERATING CIRCUIT APPLIED TO BACKLIGHT AND ASSOCIATED METHOD

(75) Inventors: Shu-Min Lin, Taichung (TW); Jyi-Si Lo, Taoyuan County (TW); Ying-Hsi Lin, Hsin-Chu (TW)

(73) Assignee: Realtek Semiconductor Corp., Science Park, HsinChu (TW)

( * ) Notice: Subject to any disclaimer, the term of this patent is extended or adjusted under 35 U.S.C. 154(b) by 768 days.

(21) Appl. No.: 13/467,048

(22) Filed: May 9, 2012

(65) Prior Publication Data

US 2012/0293081 A1 Nov. 22, 2012

(30) Foreign Application Priority Data

May 17, 2011 (TW) ..... 100117219 A

(51) Int. Cl.
*H05B 37/02* (2006.01)
*H05B 33/08* (2006.01)

(52) U.S. Cl.
CPC ..... *H05B 33/0851* (2013.01)

(58) Field of Classification Search
CPC .... H05B 37/00; H05B 37/02; H05B 33/0815; H05B 33/00; H05B 33/0851; B42D 109/02; G06F 3/147; G06F 21/84
See application file for complete search history.

(56) References Cited

U.S. PATENT DOCUMENTS 7,535,302 B2 * 5/2009 Nishimura et al. ..... 330/255
7,786,802 B2 8/2010 Liu
7,825,604 B2 11/2010 Chida
2009/0045758 A1 * 2/2009 Chida ..... 315/307
2011/0032240 A1 * 2/2011 Wang ..... G09G 3/2092 345/212
2011/0063268 A1 * 3/2011 Knapp ..... 345/207
2011/0248639 A1 * 10/2011 Peker et al. ..... 315/192

FOREIGN PATENT DOCUMENTS

CN 101097355 A 1/2008
CN 101170299 A 4/2008
CN 101176215 A 5/2008
CN 101471633 A 7/2009
TW 200843555 11/2008
TW 200917220 4/2009
TW 201028044 7/2010

* cited by examiner

*Primary Examiner* — Tuyet Vo
*Assistant Examiner* — Henry Luong
(74) *Attorney, Agent, or Firm* — Winston Hsu; Scott Margo

(57) ABSTRACT

An operating circuit applied to a backlight includes at least one current control circuit, where the current control circuit includes a transistor, an operational amplifier and a switch module. The transistor has a gate, a first electrode and a second electrode, where the first electrode is coupled to a lighting element, and the second electrode is coupled to a resistor. The operational amplifier has positive and negative input terminals, and positive and negative output terminals. The switch module switches a connection relationship between the positive input terminal, the negative input terminal, the reference voltage and the second electrode of the transistor, and switches a connection relationship between the positive output terminal, the negative output terminal and the gate of the transistor to make the close loop form a negative feedback, and the current of the lighting element not influenced by an offset voltage of the operational amplifier.

16 Claims, 7 Drawing Sheets

OPERATING CIRCUIT APPLIED TO BACKLIGHT AND ASSOCIATED METHOD

BACKGROUND OF THE INVENTION

1. Field of the Invention

The present invention relates to an operating circuit applied to a backlight, and more particularly, to an operating circuit applied to a light-emitting diode (LED) backlight and associated method.

2. Description of the Prior Art

Please refer to FIG. 1, which illustrates a prior art backlight module control system 100. As shown in FIG. 1, the backlight module control system 100 includes a LED string 110, a current control circuit 120 and a resistor $R_{ext}$, where the LED string 110 includes a plurality of LEDs, and the current control circuit 120 includes an operational amplifier 122 and a transistor M1. In the operations of the backlight module control system 100, the current control circuit 120 uses the operational amplifier 122 to form a negative feedback mechanism so as to make a feedback voltage $V_{fb}$ equal to a reference voltage $V_{ref}$. Therefore, a stable current I_LED flows through the LED string 110, where the current value I_LED=($V_{fb}$/$R_{ext}$).

However, because of the semiconductor processing variation, there is an unavoidable mismatch present in an input stage of the operational amplifier 122. That is, the input stage of the operational amplifier 122 has an offset voltage ΔV. Therefore, in actual circuits, the current I_LED provided by the current control circuit 120 is influenced by the offset voltage ΔV of the operational amplifier 122, and the current I_LED of each current control circuit 120 may be different due to different offset voltage ΔV of the operational amplifier 122. When a plurality of LED strings 110 and current control circuit 120 form a backlight module, the currents I_LED of the LED strings 110 may be different, causing the luminance-uniformity of the backlight module to be degraded.

In addition, the backlight module control system 100 is generally operated under a high-voltage environment (i.e., a supply voltage Vo ranges from 30V to 60V), therefore, the current control circuit 120 is generally manufactured by a special high-voltage process rather than a low-voltage process.

SUMMARY OF THE INVENTION

It is therefore an objective of the present invention to provide an operating circuit applied to a backlight and associated method, where luminance of lighting elements of the backlight are substantially the same, and a current control circuit of the operating circuit can be manufactured by the low-voltage process, to solve the above-mentioned problems.

According to one embodiment of the present invention, an operating circuit applied to a backlight is disclosed, where the backlight comprises at least one lighting element, the lighting element comprises at least one lighting unit. The operating circuit comprises at least one current control circuit, coupled to the lighting element, and the current control circuit is used for controlling a current of the lighting element, and comprises a first transistor, an operational amplifier and a switch module. The first transistor has a gate, a first electrode and a second electrode, where the first electrode is coupled to the lighting element, and the second electrode is coupled to a resistor. The operational amplifier has a positive input terminal, a negative input terminal, a positive output terminal and a negative output terminal. The switch module is coupled between the first transistor, the operational amplifier and a reference voltage, and is used for switching a connection relationship between the positive input terminal, the negative input terminal, the reference voltage and the second electrode of the first transistor, and for switching a connection relationship between the positive output terminal, the negative output terminal and the gate of the first transistor to make the close loop form a negative feedback, and the current of the lighting element not influenced by an offset voltage of the operational amplifier.

According to another embodiment of the present invention, an operating method applied to a backlight is disclose, where the backlight comprises at least one lighting element, the lighting element comprises at least one lighting unit. The operating method comprises: providing at least one current control circuit coupled to the lighting element, where the current control circuit is utilized for controlling a current of the lighting element, and the current control circuit comprises a first transistor, an operational amplifier and a switch module. The first transistor has a gate, a first electrode and a second electrode, where the first electrode is coupled to the lighting element, and the second electrode is coupled to a resistor. The operational amplifier has a positive input terminal, a negative input terminal, a positive output terminal and a negative output terminal. The switch module is coupled between the first transistor, the operational amplifier and a reference voltage, and is used for switching a connection relationship between the positive input terminal, the negative input terminal, the reference voltage and the second electrode of the first transistor, and for switching a connection relationship between the positive output terminal, the negative output terminal and the gate of the first transistor to make the close loop form a negative feedback, and the current of the lighting element not influenced by an offset voltage of the operational amplifier.

According to another embodiment of the present invention, an operating circuit applied to a backlight is disclosed, where the backlight comprises at least one lighting element, the lighting element comprises at least one lighting unit. The operating circuit comprises at least one current control circuit, a transistor and a control voltage generating unit. The current control circuit is coupled to the lighting element, and is used for controlling a current of the lighting element. The transistor has a gate, a first electrode and a second electrode, where the first electrode is coupled to the lighting element, and the second electrode is coupled to the current control circuit. The control voltage generating unit is coupled to the transistor, and is used for generating a control voltage to the gate of the transistor.

According to another embodiment of the present invention, an operating method applied to a backlight is disclosed, where the backlight comprises at least one lighting element, the lighting element comprises at least one lighting unit. The operating method comprises: providing at least one current control circuit coupled to the lighting element, where the current control circuit is utilized for controlling a current of the lighting element; providing a transistor having a gate, a first electrode and a second electrode, where the first electrode is coupled to the lighting element, and the second electrode is coupled to the current control circuit; and generating a control voltage to the gate of the transistor.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
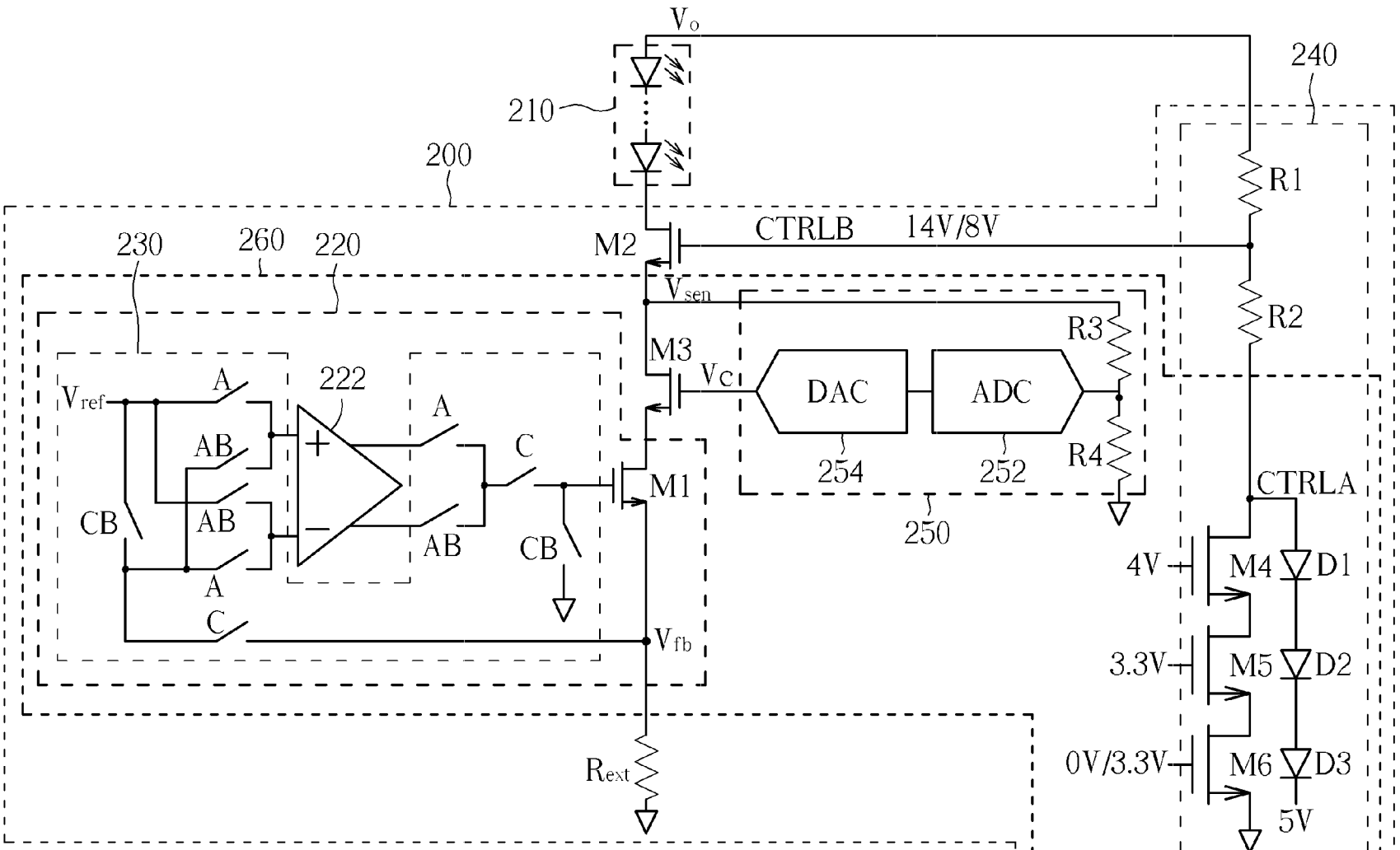
FIG. 2 is a diagram illustrating an operating circuit applied to a backlight according to one embodiment of the present invention

Please refer to FIG. 2, which illustrates an operating circuit 200 applied to a backlight according to one embodiment of the present invention, where the backlight comprises at least one lighting element, and each lighting element comprises at least one lighting unit. In this embodiment, each lighting unit is a LED, and the lighting element is an LED string 210. As shown in FIG. 2, the operating circuit 200 includes transistors M2 and M3, a resistor $R_{ext}$, a current control circuit 220, a first control voltage generating unit 240, a second control voltage generating unit 250, where the current control circuit 220 includes an operational amplifier 222, a switch module 230 and a transistor M1. The switch module 230 includes a plurality of switches, and is used to switch the connection relationship between two input terminals of the operational amplifier 222, a reference voltage $V_{ref}$ and a feedback voltage $V_{fb}$, and to switch the connection relationship between two output terminals of the operational amplifier 222 and a gate of the transistor M1, to make the current control circuit 220 has a negative feedback loop. In addition, the first control voltage generating unit 240 includes two resistors R1 and R2, three transistors M4, M5 and M6 and three diodes D1, D2 and D3. The second control voltage generating unit 250 includes two resistors R3 and R4, an analog-to-digital converter (ADC) 252 and a digital-to-analog converter (DAC) 254.

It is noted that, although the operating circuit 200 shown in FIG. 2 includes only one LED string 210 and its related circuit (i.e., transistors M2 and M3, resistor $R_{ext}$, current control circuit 220 and second control voltage generating unit 250 . . . etc.), it is not meant to be a limitation of the present invention. In other embodiments of the present invention, the operating circuit 200 can have a plurality of LED strings 210 and their related circuits, that is, the operating circuit 200 can include a plurality of circuit groups, where each circuit group includes the LED string 210, the transistors M2 and M3, the resistor $R_{ext}$, the current control circuit 220 and the second control voltage generating unit 250.

In addition, the current control circuit 220, the transistor M1 and M3, the second voltage control circuit 250 and a portion of the first voltage control circuit 240 of the operating circuit 200 are built in a single chip 260, and the other circuits of the operating circuit 200 (e.g. the transistor M2 and the resistors R1 and R2) outside the chip 260 are circuit elements attached on a printed circuit board (PCB). The chip 260 is manufactured by a low-voltage process (for example, the voltage endurance of the chip 260 is 9V). In addition, in this embodiment, the voltage endurance of the transistors M3 and M4 are greater than the voltage endurance of the transistors M1, M5 and M6.

Figure 3:
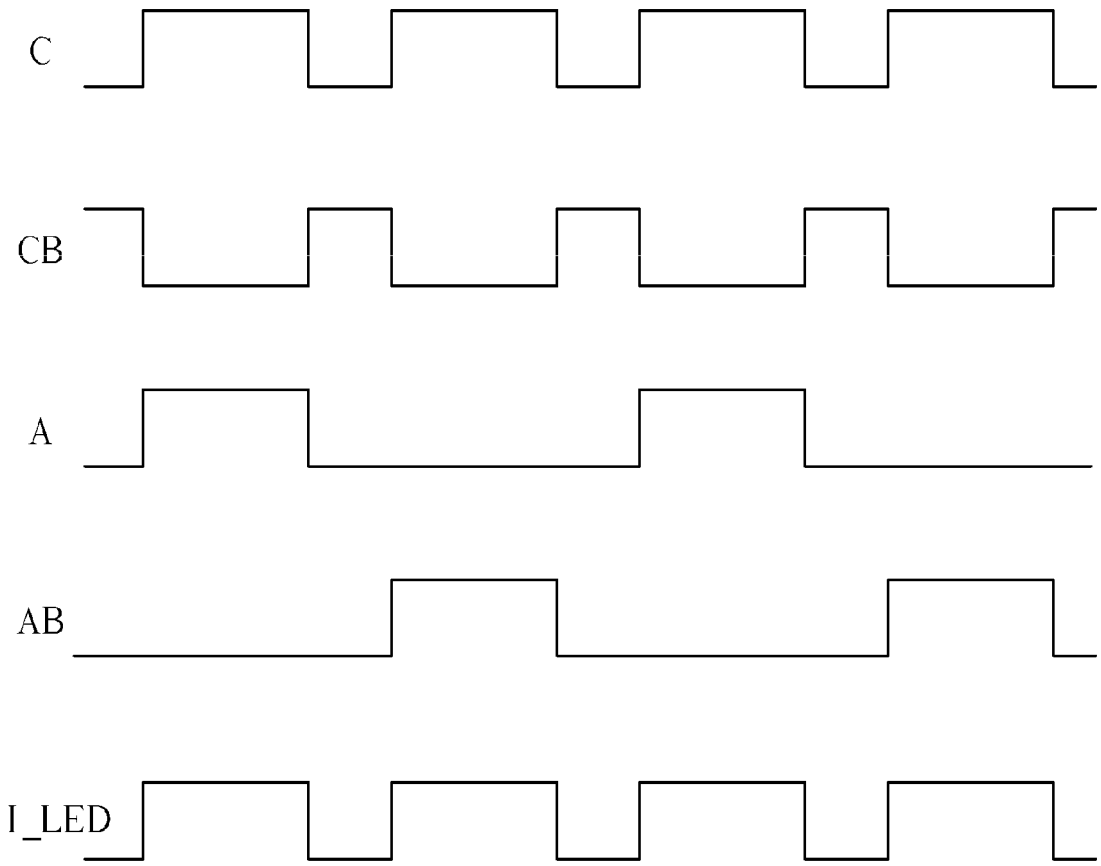
FIG. 3 is a diagram illustrating a timing diagram of control signals used to control switches of the switch module.

Please refer to FIG. 2 and FIG. 3 together. FIG. 3 is a diagram illustrating a timing diagram of control signals C, CB, A and AB used to control switches of the switch module 230. As shown in FIG. 2 and FIG. 3, the control signal C is a pulse width modulation (PWM) signal used to control the enabling state/disabling state of the LED string 210, the control signal CB is an inverse of the control signal C, and the control signals A and AB are generated from the control signal C by some logic circuits.

Figure 4:
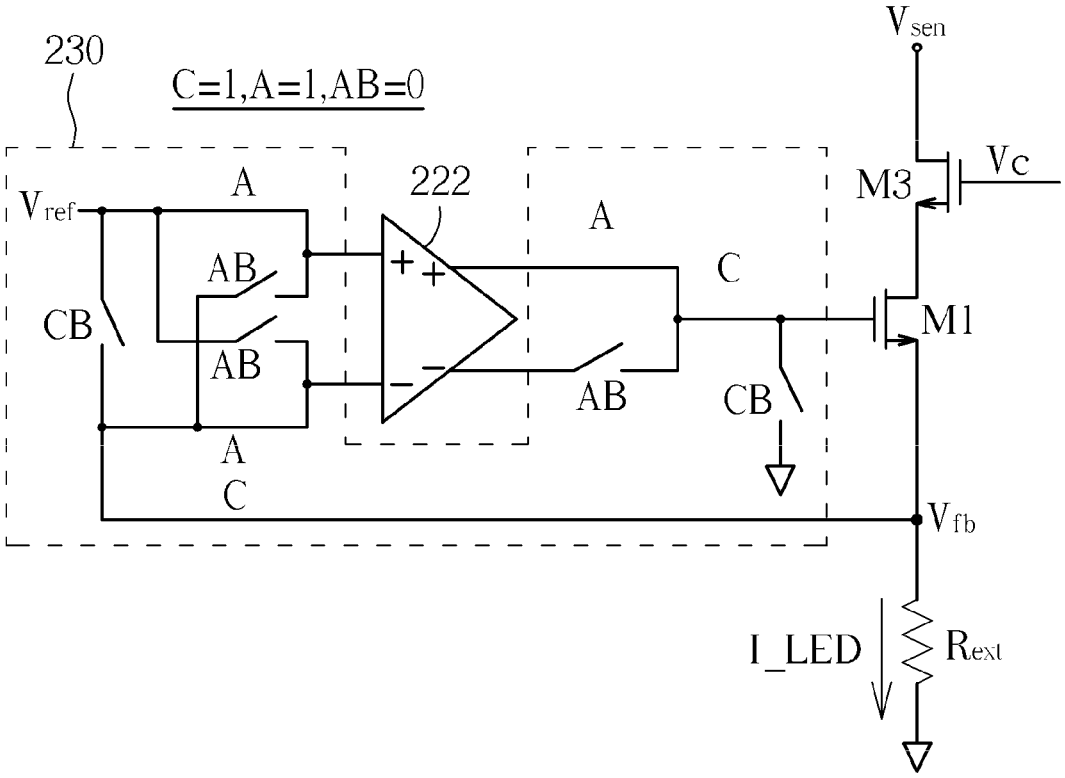
FIG. 4 is a diagram illustrating the switch module when the control signals A=1 and AB=0.

In the operation of the operating circuit 200, please refer to FIG. 4, during a first period (i.e., an active period (high voltage level) of a first cycle of the control signal C shown in FIG. 3), C=1, A=1 and AB=0, the switch module 230 is controlled to connect a positive input terminal of the operational amplifier 222 to the reference voltage $V_{ref}$, to connect a negative input terminal of the operational amplifier 222 to a source of the transistor M1, and to connect a positive output terminal of the operational amplifier 222 to the gate of the transistor M1 to make the close loop form a negative feedback. Assuming that the operational amplifier 222 has the offset voltage ΔV, the feedback voltage $V_{fb}$ is equal to $(V_{ref}+\Delta V)$, that is the current I_LED flowing through the LED string 210 and the transistors M1-M3 is equal to $(V_{ref}+\Delta V)/R_{ext}$.

Figure 5:
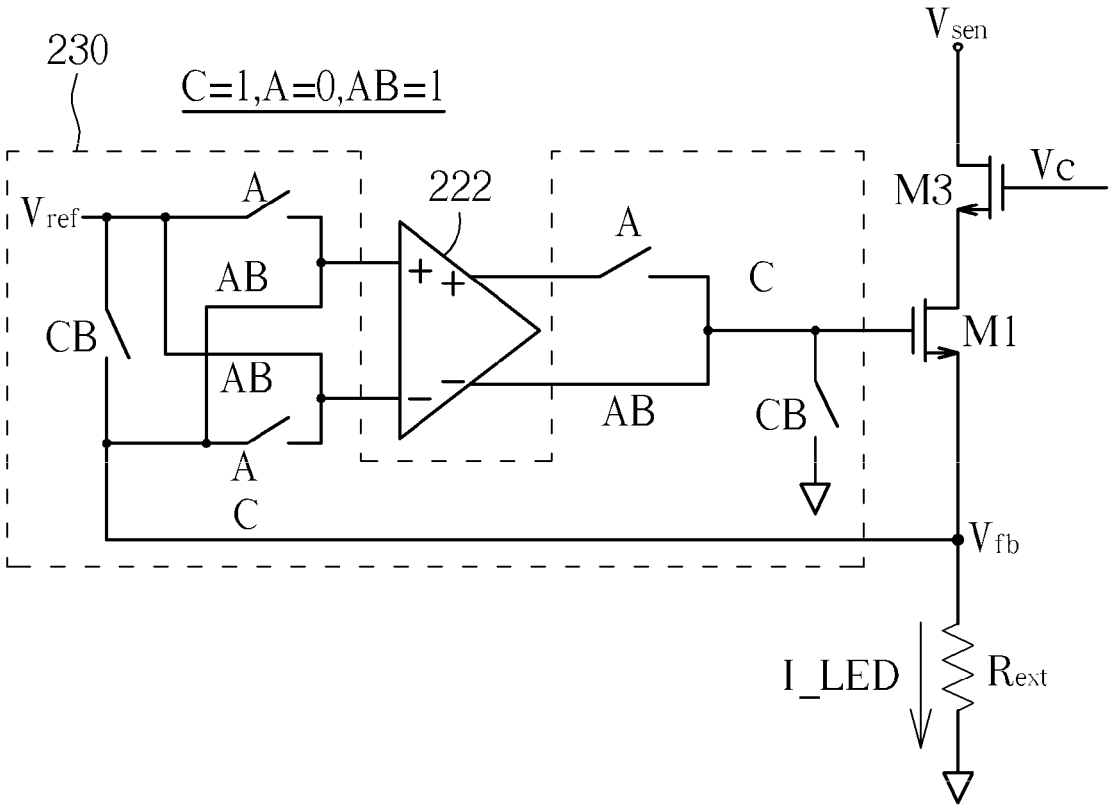
FIG. 5 is a diagram illustrating the switch module when the control signals A=0 and AB=1.

Then, please refer to FIG. 5, during a second period (i.e., an active period (high voltage level) of a second cycle of the control signal C shown in FIG. 3), C=1, A=0 and AB=1, the switch module 230 is controlled to connect the positive input terminal of the operational amplifier 222 to the source of the transistor M1, to connect a negative input terminal of the operational amplifier 222 to the reference voltage $V_{ref}$, and to connect a negative output terminal of the operational amplifier 222 to the gate of the transistor M1 to make the close loop form a negative feedback. Assuming that the operational amplifier 222 has the offset voltage ΔV, the feedback voltage $V_{fb}$ is equal to $(V_{ref}-\Delta V)$, that is the current I_LED flowing through the LED string 210 and the transistors M1-M3 is equal to $(V_{ref}-\Delta V)/R_{ext}$.

In light of above, when the LED string 210 is enabled, the current I_LED flowing through the LED string 210 is sequentially equal to $(V_{ref}+\Delta V)/R_{ext}$, $(V_{ref}-\Delta V)/R_{ext}$, $(V_{ref}+\Delta V)/R_{ext}$, $(V_{ref}-\Delta V)/R_{ext}$, . . . . Therefore, the average current of the LED string 210, during the LED string 210 is enabled, will be equal to $(V_{ref}/R_{ext})$. Assuming that the backlight includes a plurality of LED strings and a plurality of corresponding operational amplifiers having different offset voltages, using the above-mentioned operations of the operational circuit 200 can make the currents of all the LED strings are equal to $(V_{ref}/R_{ext})$, and the luminance of all the LED strings will be the same.

In addition, in the embodiment shown in FIG. 2, the operational amplifier 222 has a differential output, but it is not meant to be a limitation of the present invention. In other embodiments of the present invention, the two switches connected to the output terminals of the operational amplifier 222 and controlled by the control signals A and AB can be built in the operational amplifier 222. That is, the operational amplifier 222 has a single-ended output.

On the other hand, please refer to FIG. 2, when the LED string 210 is disabled (i.e. when the control signal C shown in FIG. 3 is equal to "0"), a voltage level of a node between the LED string 210 and the transistor M2 will be higher than 30 volts. Therefore, the transistors M2 and M3 shown in FIG. 2 are designed to prevent the circuits of the chip 260 from being burned out.

In one embodiment of the present invention, the transistor M2 is manufactured by the high-voltage process, and is used to solve the above-mentioned issue (i.e., the voltage of the under node of the LED string 210 is higher than 30 volts). However, considering the temperature endurance of the transistor M2, the product of a current and a voltage of the transistor M2 can not be too great. Therefore, a control voltage CTRLB applied to the gate of the transistor M2 requires a special design. In this embodiment, when the LED string 210 is enabled (i.e., the control signal C shown in FIG. 3 is equal to "1"), the control voltage CTRLB outputted from the first control voltage generating unit 240 is 14V, and the transistor M2 is operated in a triode region to avoid the over-high temperature of the transistor M2. In addition, when the LED string 210 is disabled (i.e., the control signal C shown in FIG. 3 is equal to "0"), the control voltage CTRLB outputted from the first control voltage generating unit 240 is 8V, and the transistor M2 is disabled to control the voltage $V_{sen}$ lower than 8V that is lower than the voltage endurance of the chip 260.

To control the control voltage CTRLB to switch between 14V and 8V, in this embodiment, a voltage level of a control voltage CTRLA is changed to make the control voltage CTRLB able to be obtained by using the resistors R1 and R2 to divide the supply voltage Vo. In detail, when the LED string 210 is enabled (i.e., the control signal C shown in FIG. 3 is equal to "1"), a voltage applied to a gate of the transistor M6 is set to 0V, and the diodes D1-D3 are turned on and the transistors M4-M6 are disabled. Therefore, the control voltage CTRLA is equal to 8V, and the control voltage CTRLB is equal to 14V. In addition, when the LED string 210 is disabled (i.e., the control signal C shown in FIG. 3 is equal to "0"), the voltage applied to the gate of the transistor M6 is set to be 3.3V, and the diodes D1-D3 are reverse biased and the transistors M4-M6 are enabled. Therefore, the control voltage CTRLA is equal to 0V, and the control voltage CTRLB is equal to 8V.

It is noted that, the voltage levels of the control voltages CTRLA and CTRLB and gates of the transistors M4-M6 are for illustrative purposes only, and are not meant to be a limitation of the present invention. In addition, the circuit structure shown in FIG. 2 is also for illustrative purposes only, as long as the control voltage CTRLB generated from the first control voltage generating unit 240 can make the transistor M2 operated in the triode region when the LED string 210 is enabled, and to make the transistor M2 disabled when the LED string 210 is disabled, the first control voltage generating unit 240 can be implemented by any other circuit structure. These alternative designs should fall within the scope of the present invention.

In addition, in the operating circuit 200, the operating range of the voltage $V_{sen}$ is very large, about 0.5V-8.5V. Therefore, in order to make the transistor M1 always operated in a safe situation, the voltage $V_{sen}$ is divided by resistors R3 and R4 inputted into the ADC 252 to generate a digital signal, then the DAC 254 receives the digital signal to generate a control voltage Vc. In other words, the second control voltage generating unit 250 dynamically adjusts the control voltage according to the voltage $V_{sen}$. That is, when the voltage $V_{sen}$ increases, the control voltage Vc also increases; and when the voltage $V_{sen}$ decreases, the control voltage Vc also decreases, to prevent the transistor M1 from damage due to a large cross voltage.

In addition, the circuit structure of the second control voltage generating unit 250 is for illustrative purposes only. As long as the control voltage Vc generated from the second control voltage generating unit 250 is dynamically adjusted according to the voltage $V_{sen}$, the second control voltage generating unit 250 can be implemented by any other circuit structure. These alternative designs should fall within the scope of the present invention.

In another embodiment of the present invention, the chip 260 can also be manufactured by the high-voltage process, and the transistors M2 and M3, the first control voltage generating unit 240 and the second control voltage generating unit 250 shown in FIG. 2 can be removed from the operating circuit 200, that is a drain of the transistor M1 is directly connected to the LED string 210. As long as the current control circuit 220 includes the switch module 230 to switch the connection relationship between two input terminals of the operational amplifier 222, a reference voltage $V_{ref}$ and a feedback voltage $V_{fb}$, and to switch the connection relationship between two output terminals of the operational amplifier 222 and the gate of the transistor M1 to make the current control circuit 220 has a negative feedback loop, these alternative designs should fall within the scope of the present invention.

Figure 1:
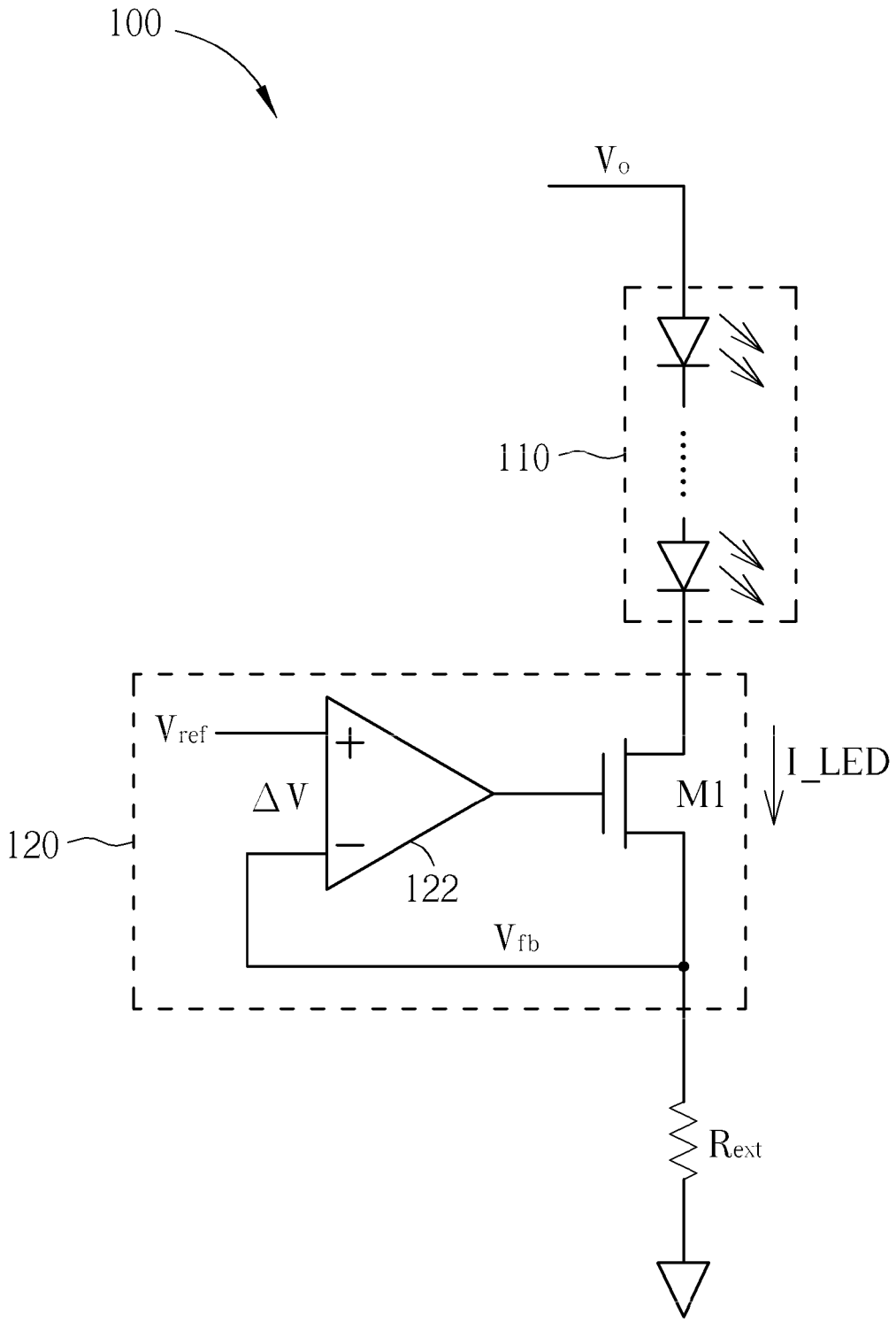
FIG. 1 PRIOR ART
FIG. 1 is a diagram illustrating a prior art backlight module control system.

In another embodiment of the present invention, the current control circuit 220 shown in FIG. 2 can be replaced by any other current control circuit (e.g., the prior art current control circuit 120 shown in FIG. 1) that does not include the switch module 230 shown in FIG. 2. That is, as long as the chip 260 is manufactured by the low-voltage process, and the transistor M2 is coupled between the current control circuit and the LED string 210 to prevent the voltage $V_{sen}$ being greater than the voltage endurance of the chip 260, these alternative designs should fall within the scope of the present invention.

Figure 6:
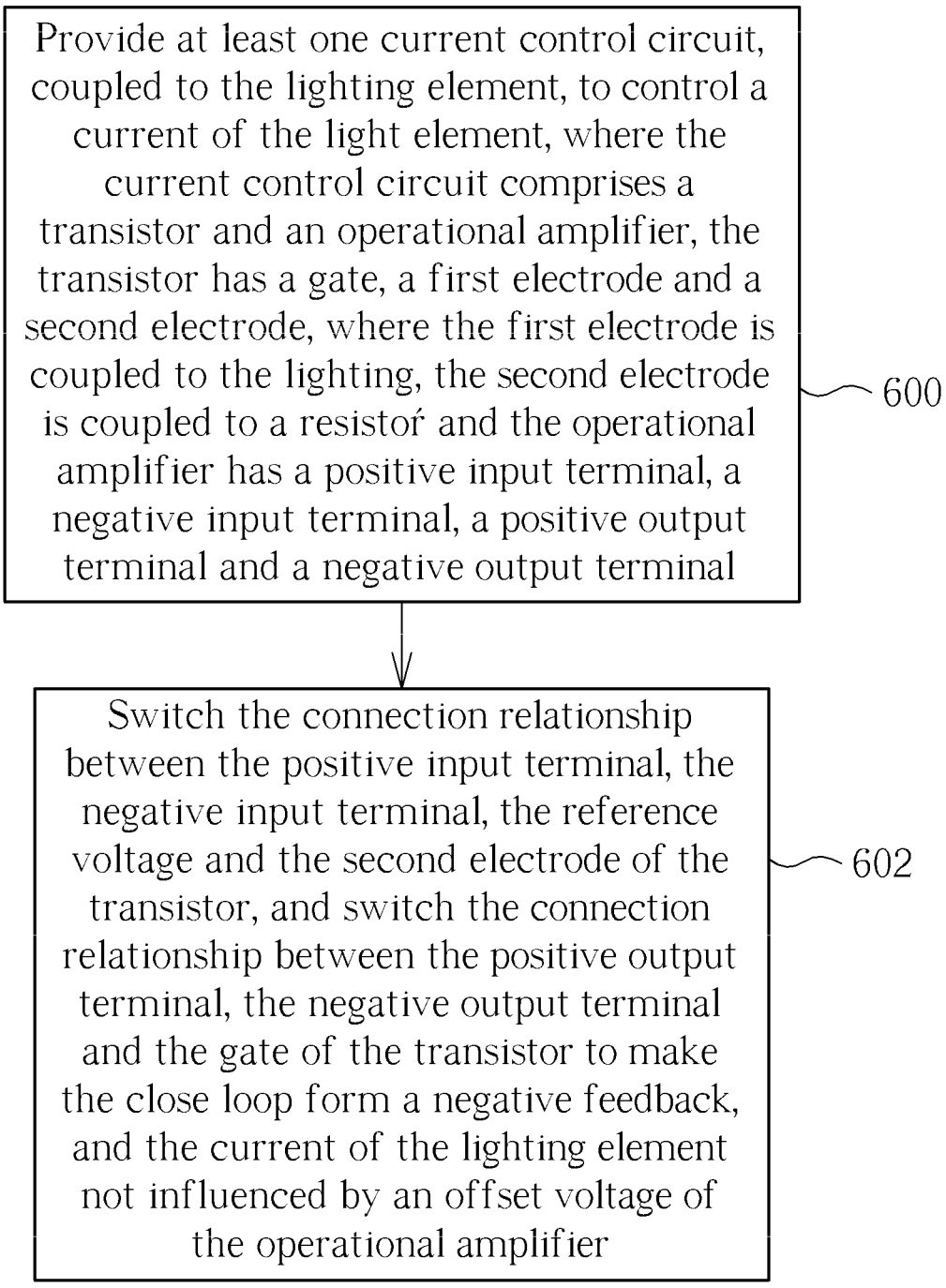
FIG. 6 is a flowchart of an operating method applied to a backlight according to a first embodiment of the present invention.

Please refer to FIG. 6, which is a flowchart of an operating method applied to a backlight according to a first embodiment of the present invention, where the backlight comprises a plurality of lighting elements, and each of the lighting elements comprises at least one lighting unit. Referring to FIG. 2 and FIG. 6, the flow is described as follows:

Step 600: provide at least one current control circuit, coupled to the lighting element, to control a current of the light element, where the current control circuit comprises a transistor and an operational amplifier, the transistor has a gate, a first electrode and a second electrode, where the first electrode is coupled to the lighting, the second electrode is coupled to a resistor; and the operational amplifier has a positive input terminal, a negative input terminal, a positive output terminal and a negative output terminal.

Step 602: switch the connection relationship between the positive input terminal, the negative input terminal, the reference voltage and the second electrode of the transistor, and switch the connection relationship between the positive output terminal, the negative output terminal and the gate of the transistor to make the close loop form a negative feedback, and the current of the lighting element not influenced by an offset voltage of the operational amplifier.

Figure 7:
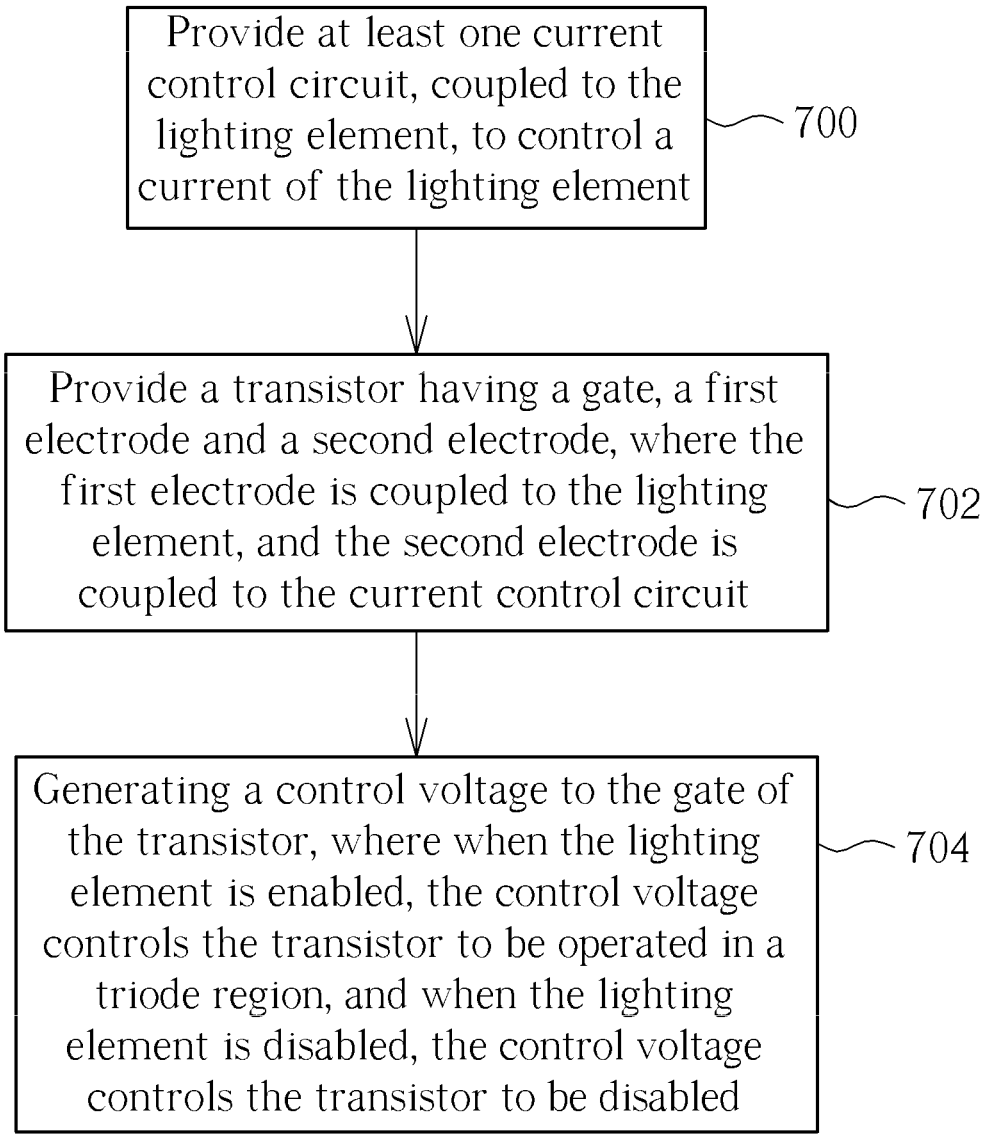
FIG. 7 is a flowchart of an operating method applied to a backlight according to a second embodiment of the present invention.

Please refer to FIG. 7, which is a flowchart of an operating method applied to a backlight according to a second embodiment of the present invention, where the backlight comprises a plurality of lighting elements, and each of the lighting elements comprises at least one lighting unit. Referring to FIG. 2 and FIG. 7, the flow is described as follows:

Step 700: provide at least one current control circuit, coupled to the lighting element, to control a current of the lighting element.

Step 702: provide a transistor having a gate, a first electrode and a second electrode, where the first electrode is coupled to the lighting element, and the second electrode is coupled to the current control circuit.

Step 704: generating a control voltage to the gate of the transistor, where when the lighting element is enabled, the control voltage controls the transistor to be operated in a triode region, and when the lighting element is disabled, the control voltage controls the transistor to be disabled.

Briefly summarized, in the operating circuit and associated method of the present invention, the influence of the offset voltage of the operational amplifier is cancelled to make all the LED strings have the same current, and the luminance of all the LED strings will be the same. In addition, the chip of the operating circuit is manufactured by the low-voltage process to lower the manufacturing cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An operating circuit applied to a backlight, wherein the backlight comprises at least one lighting element, the lighting element comprises at least one lighting unit, and the operating circuit comprises:

at least one current control circuit, coupled to the lighting element, for controlling a current of the lighting element, wherein the current control circuit comprises:

a first transistor having a gate, a first electrode and a second electrode, wherein the first electrode is coupled to the lighting element, and the second electrode is coupled to a resistor;

an operational amplifier having a positive input terminal, a negative input terminal, a positive output terminal and a negative output terminal; and a switch module, coupled between the first transistor, the operational amplifier and a reference voltage, for switching a connection relationship between the positive input terminal, the negative input terminal, the reference voltage and the second electrode of the first transistor, and for switching a connection relationship between the positive output terminal, the negative output terminal and the gate of the first transistor to make the close loop form a negative feedback, and the current of the lighting element not influenced by an offset voltage of the operational amplifier.

2. The operating circuit of claim 1, wherein during a first period, the switch module is controlled to connect the positive input terminal of the operational amplifier to the reference voltage, and to connect the negative input terminal of the operational amplifier to the second electrode of the first transistor, and to connect the positive output terminal to the gate of the first transistor; and during a second period, the switch module is controlled to connect the positive input terminal of the operational amplifier to the second electrode of the first transistor, and to connect the negative input terminal of the operational amplifier to the reference voltage, and to connect the negative output terminal to the gate of the first transistor.

3. The operating circuit of claim 2, wherein the first period and the second period are active periods of two adjacent cycles of a pulse width modulation signal, respectively, and the pulse width modulation signal is utilized for controlling an enabling state/disabling state of the lighting element.

4. The operating circuit of claim 1, further comprising:

a second transistor having a gate, a first electrode and a second electrode, wherein the first electrode is coupled to the lighting element, and the second electrode is coupled to the first electrode of the first transistor; and a first control voltage generating unit, coupled to the second transistor, for generating a first control voltage to the gate of the second transistor.

5. The operating circuit of claim 4, wherein when the lighting element is enabled, the first control voltage generating unit controls the second transistor to be operated in a triode region; and when the lighting element is disabled, the first control voltage generating unit controls the second transistor to be disabled.

6. The operating circuit of claim 1, further comprising:

a third transistor having a gate, a first electrode and a second electrode, wherein the first electrode is coupled to the lighting element, and the second electrode is coupled to the first electrode of the first transistor; and a second control voltage generating unit, coupled to the third transistor, for generating a second control voltage to the gate of the third transistor according to a voltage level of the first electrode of the third transistor.

7. The operating circuit of claim 6, wherein the second control voltage generating unit comprises:

an analog-to-digital converter, for generating a digital signal according to the voltage level of the first electrode of the third transistor; and a digital-to-analog converter, coupled to the analog-to-digital converter, for receiving the digital signal to generate the second control voltage.

8. The operating circuit of claim 1, wherein the lighting unit is a light-emitting diode (LED), and the lighting element is a LED string.

9. An operating method applied to a backlight, wherein the backlight comprises at least one lighting element, the lighting element comprises at least one lighting unit, and the operating method comprises:

providing at least one current control circuit coupled to the lighting element, wherein the current control circuit is utilized for controlling a current of the lighting element, and the current control circuit comprises:

a first transistor having a gate, a first electrode and a second electrode, wherein the first electrode is coupled to the lighting element, and the second electrode is coupled to a resistor;

an operational amplifier having a positive input terminal, a negative input terminal, a positive output terminal and a negative output terminal; and switching a connection relationship between the positive input terminal, the negative input terminal, a reference voltage and the second electrode of the first transistor, and switching a connection relationship between the positive output terminal, the negative output terminal and the gate of the first transistor to make the close loop form a negative feedback, and the current of the lighting element not influenced by an offset voltage of the operational amplifier.

10. The operating method of claim 9, wherein a step of switching the connection relationship between the positive input terminal, the negative input terminal, the reference voltage and the second electrode of the first transistor, and switching the connection relationship between the positive output terminal, the negative output terminal and the gate of the transistor comprises:

during a first period, connecting the positive input terminal of the operational amplifier to the reference voltage, connecting the negative input terminal of the operational amplifier to the second electrode of the first transistor, and connecting the positive output terminal to the gate of the first transistor; and during a second period, connecting the positive input terminal of the operational amplifier to the second electrode of the first transistor, connecting the negative input terminal of the operational amplifier to the reference voltage, and connecting the negative output terminal to the gate of the first transistor.

11. The operating method of claim 10, wherein the first period and the second period are active periods of two adjacent cycles of a pulse width modulation signal, respectively, and the pulse width modulation signal is utilized for controlling an enabling state/disabling state of the lighting element.

12. The operating method of claim 9, further comprising:

providing a second transistor having a gate, a first electrode and a second electrode, wherein the first electrode is coupled to the lighting element, and the second electrode is coupled to the first electrode of the first transistor; and generating a first control voltage to the gate of the second transistor.

13. The operating method of claim 12, wherein a step of generating the first control voltage to the gate of the second transistor comprises:

when the lighting element is enabled, controlling the second transistor to be operated in a triode region; and when the lighting element is disabled, controlling the second transistor to be disabled.

14. The operating method of claim 9, further comprising:

providing a third transistor having a gate, a first electrode and a second electrode, wherein the first electrode is coupled to the lighting element, and the second electrode is coupled to the first electrode of the first transistor; and generating a second control voltage to the gate of the third transistor according to a voltage level of the first electrode of the third transistor.

15. The operating method of claim 14, wherein a step of generating the second control voltage to the gate of the third transistor according to the voltage level of the first electrode of the third transistor comprises:

generating a digital signal according to the voltage level of the first electrode of the third transistor; and receiving the digital signal to generate the second control voltage.

16. The operating method of claim 9, wherein the lighting unit is a light-emitting diode (LED), and the lighting element is a LED string.

* * * * *